US006008764A

United States Patent [19]

Ollikainen et al.

[11] Patent Number: 6,008,764

[45] Date of Patent: Dec. 28, 1999

[54] BROADBAND ANTENNA REALIZED WITH SHORTED MICROSTRIPS

[75] Inventors: Jani Ollikainen; Pertti Vainikainen, both of Espoo, Finland

[73] Assignee: Nokia Mobile Phones Limited, Espoo, Finland

[21] Appl. No.: 09/047,149

[22] Filed: Mar. 24, 1998

[30] Foreign Application Priority Data

Mar. 25, 1997 [FI] Finland ..... 971235

[51] Int. Cl.[6] ..... H01Q 1/38

[52] U.S. Cl. ..... 343/700 MS; 343/702; 343/846

[58] Field of Search ..... 343/700 MS, 702, 343/846; H01Q 1/38

[56] References Cited

U.S. PATENT DOCUMENTS

| | | | |
|---|---|---|---|
| 4,907,006 | 3/1990 | Nishikawa et al. | 343/700 MS |
| 4,998,078 | 3/1991 | Hulkko | 333/109 |
| 5,124,733 | 6/1992 | Haneishi | 343/700 MS |
| 5,138,329 | 8/1992 | Saarnimo et al. | 343/702 |
| 5,341,149 | 8/1994 | Valimaa et al. | 343/895 |
| 5,365,246 | 11/1994 | Rasinger et al. | 343/702 |
| 5,561,439 | 10/1996 | Moilanen | 343/846 |
| 5,568,155 | 10/1996 | Tsunekawa et al. | 343/700 MS |
| 5,627,550 | 5/1997 | Sanad | 343/700 MS |
| 5,657,028 | 8/1997 | Sanad | 343/700 MS |
| 5,680,144 | 10/1997 | Sanad | 343/700 MS |
| 5,764,190 | 6/1998 | Murch et al. | 343/700 MS |
| 5,801,660 | 9/1998 | Ohtsuka et al. | 343/700 MS |

FOREIGN PATENT DOCUMENTS

| | | |
|---|---|---|
| 0 176 311 | 4/1986 | European Pat. Off. . |
| 0 226 390 | 6/1987 | European Pat. Off. . |
| 0 270 209 | 6/1988 | European Pat. Off. . |
| 0 400 872 | 12/1990 | European Pat. Off. . |
| 0 777 295 A2 | 6/1997 | European Pat. Off. . |
| 26 33 757 | 4/1977 | Germany . |
| 2 147 744 | 5/1985 | United Kingdom . |
| WO 96/27219 | 9/1996 | WIPO . |

*Primary Examiner*—Don Wong
*Assistant Examiner*—Hoang Nguyen
*Attorney, Agent, or Firm*—Perman & Green, LLP

[57] ABSTRACT

The invention relates to antenna structures, particularly to substantially planar broadband antennas realized by microstrips. The antenna structure according to the invention has at least two superimposed strips (10, 20), which have a length of about a quarter-wave and which at one end are short circuited to the ground plane (30). The strips (10, 20) have certain resonance frequencies, which are tuned close to each other so that the operating band of the antenna structure is substantially continuous.

7 Claims, 8 Drawing Sheets

BROADBAND ANTENNA REALIZED WITH SHORTED MICROSTRIPS

The invention relates to antenna structures and more particularly to broadband antennas realised with microstrips.

A conventional microstrips antenna comprises a ground plane and a radiator isolated from the ground plane by a dielectric layer. The resonance frequency of the microstrips antenna is determined by the dimensions of the radiator and the distances between the radiator and the ground plane.

Further there are such known microstrips antenna structures where one edge of the radiator is shorted to the ground plane. In this arrangement a certain resonance frequency is obtained with significantly smaller physical dimensions than in the above described simple microstrips antenna.

However, a problem of the prior art structures is that they are thick and have a narrow bandwidth. The antennas used in personal mobile stations must have a small size. However, when a microstrips antenna is made thinner its useful bandwidth is reduced. Many mobile stations require a relatively wide frequency band, e.g. in the DCS-1800 system a relative frequency band which is about 10% of the centre frequency. With prior art microstrips antenna structures it is not possible to realise an antenna which at the same time is thin enough and has a sufficiently wide bandwidth. Different microstrips antenna structures are described for instance in the books "Handbook of Microstrips Antennas", J. R. James and P. S. Hall (Eds), Vol. 1, Peter Peregrinus Ltd, London 1989; and "Analysis, Design and Measurement of Small and Low-Profile Antennas", K. Hirasawa and M. Haneishi, Artech House, Boston 1992.

FIG. 1*a* shows a microstrips antenna structure described in the above mentioned book "Handbook of Microstrips Antennas", whereby the structure comprises two radiating strips 10, 20 and a ground plane 30. Power is fed into the lower strip 20, whereby the upper strip operates as a parasitic radiator. The resonance frequencies of the strips 10, 20 are tuned to be slightly different, whereby the relatively weak coupling between the strips 10, 20 results in a high return loss for the antenna structure, also in the band between the resonance frequencies of the strips, whereby the antenna operates effectively on a continuous wide frequency band. This fact is illustrated in FIG. 1*b*, which shows an example of the return loss of a antenna structure of this type. FIG. 1*b* shows the resonance frequencies $f_1$ and $f_2$ of the strips 10, 20, and the frequency boundaries f3 and f4 for a return loss of over 10 dB, which define the useful frequency band of said antenna structure.

The disadvantage of such a structure is its thickness: it is not possible to realise an antenna structure according to FIG. 1*a* which is arbitrary thin, because when the distance between the strips is reduced their mutual coupling is increased, whereby the resonance frequencies of the strips are drawn farther apart and the broadband function is lost. The same book also presents a double-band microstrips antenna, which is shown in FIG. 1*c*. In this structure the power is supplied to the upper strip 10. In a structure of this kind there is a strong coupling between the strips 10, 20 via the line feeding the antenna, whereby the strips 10, 20 have different resonance frequencies. Thus an antenna structure of this kind has two different narrow operating bands.

If the coupling is too strong, then the resonance frequencies $f_1$ and $f_2$ will move so far apart that the antenna structure will not have a wide operating band. This situation is illustrated in FIG. 1*d*, where it is seen that in this case the useful frequency band of the antenna structure is not continuous, but this represents an antenna resonating at two different operating frequencies.

The U.S. Pat. No. 5,124,733 (Haneishi) presents an antenna structure according to FIG. 2, which combines the open microstrips antenna structure with two operating bands presented in FIG. 1*c*, with a quarter-wave microstrips structure, which results in a small-sized microstrips antenna with two bands. In this structure the strips 10, 20 of one end of the respective strip are shorted to the ground plane 30. Because said patent publication presents a double-band antenna structure, the stronger coupling between the strips caused by the shorted strips does not hamper the operation of the antenna, as the antenna operates on two frequency bands already due to the strong coupling between the strips caused by the feeding to the upper strip 10. However, said publication does not present a broadband antenna structure.

The object of the invention is to realise a small-sized, broadband, planar antenna applicable in a personal mobile station. An object of the invention is also to realise a broadband microstrips antenna which is as thin as possible. A further object of the invention is to realise a structure which meets the above requirements and which further is well suited for serial production.

The objects are attained by realising an antenna structure having at least two superimposed short-circuited microstrips with a length of about one quarter-wave, by tuning the resonance frequencies of the strips to be slightly different, by arranging, the antenna feed to the lower strip, and by arranging the coupling between the strips to be sufficiently weak, whereby the resonance frequencies of the strips form a continuous operating band.

The microstrips antenna according to the invention is characterised in that which is stated in the characterizing portion of the independent claim directed to a microstrips antenna. The mobile station according to the invention is characterised in that which is stated in the characterizing portion of the independent claim directed to a mobile station. The dependent claims describe further advantageous embodiments of the invention.

The invention is described in more detail below with reference to preferred embodiments presented as examples, and to the enclosed figures, in which:

FIG. 1*a* shows a prior art open microstrips antenna structure;

FIG. 1*b* shows the return loss as a function of frequency in the structure according to FIG. 1*a;*

FIG. 1*c* shows another prior art open microstrips antenna structure;

FIG. 1*d* shows the return loss as a function of frequency in the structure according to FIG. 1*c;*

Figure 5A:
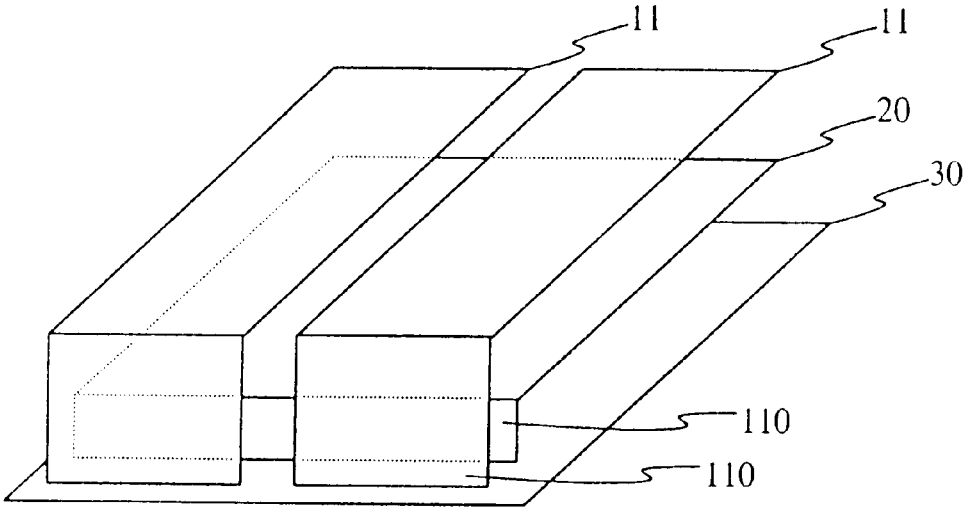
Figure 5B:
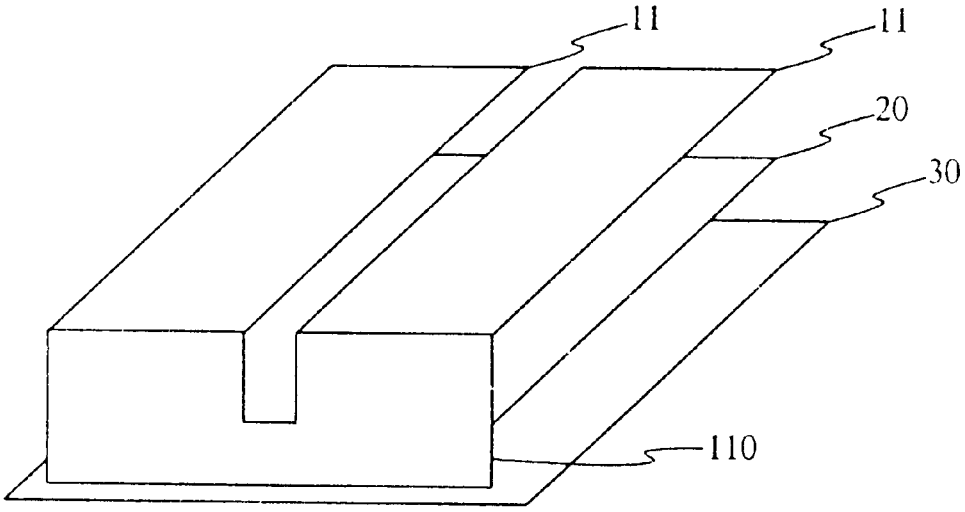
Figure 5C:
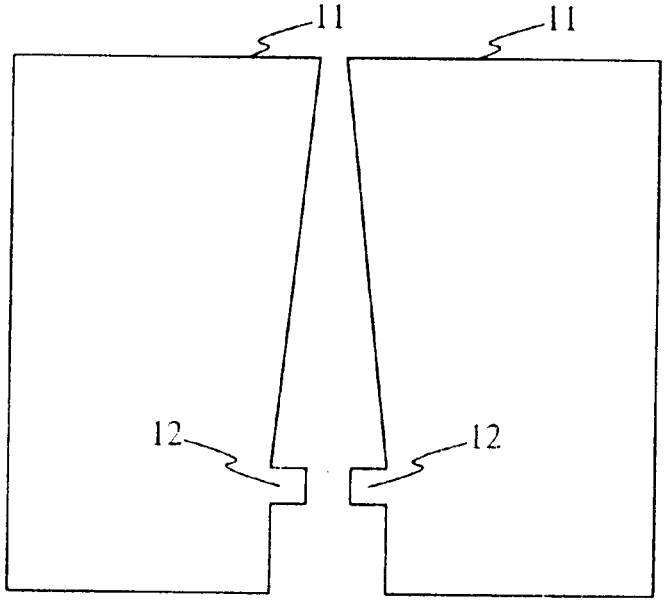
Figure 5D:
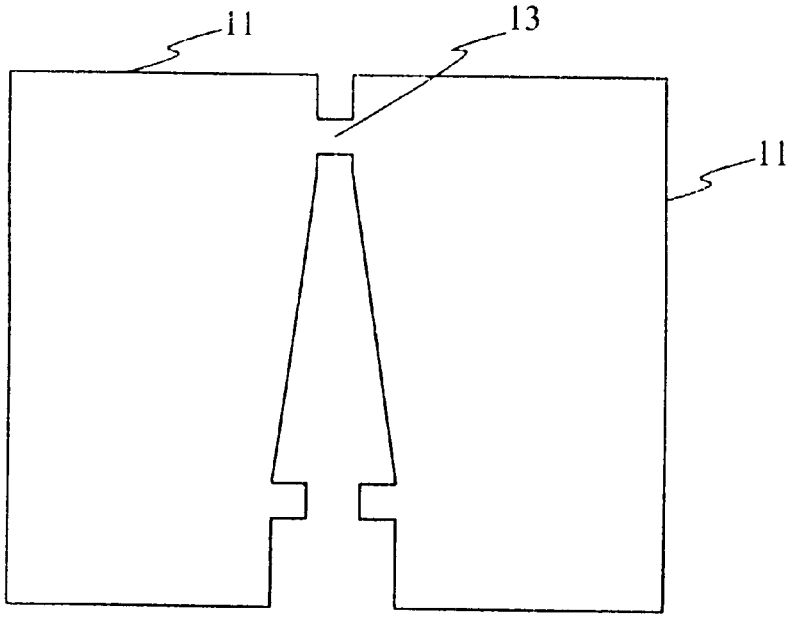
Figure 6:
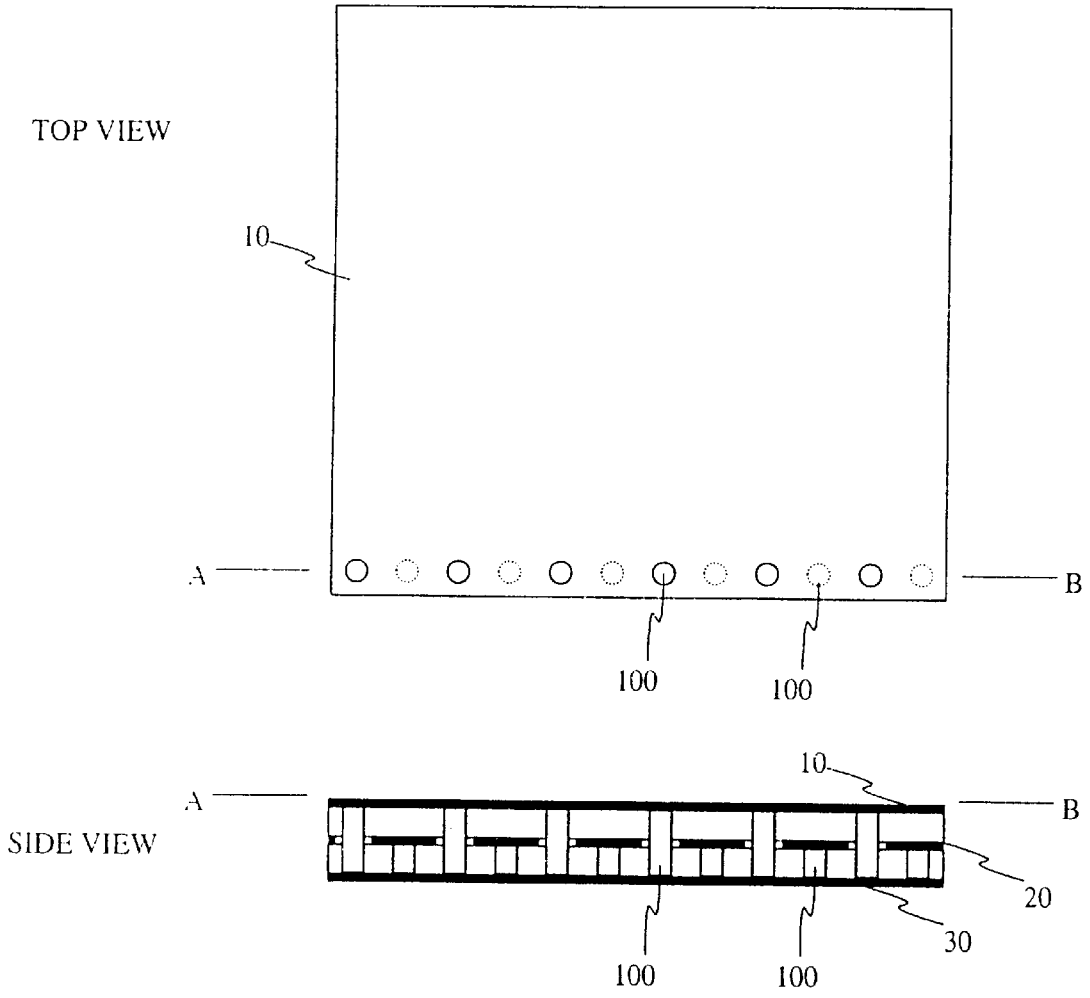
Figure 7:
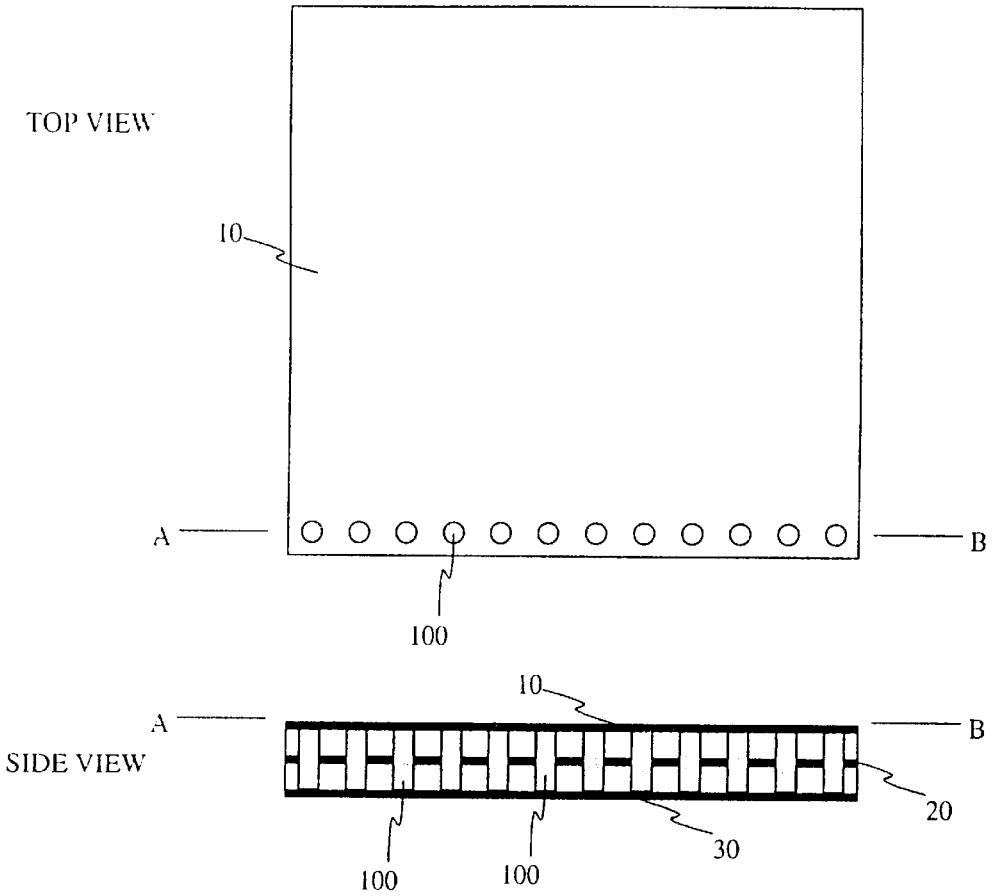
Figure 8:
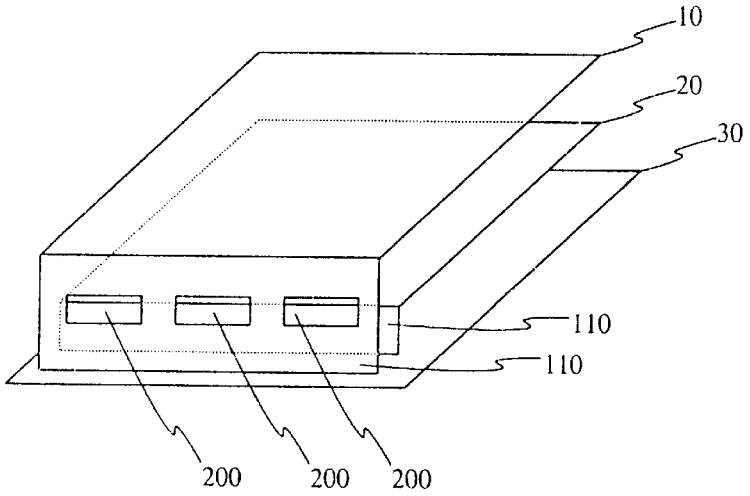
Figure 9:
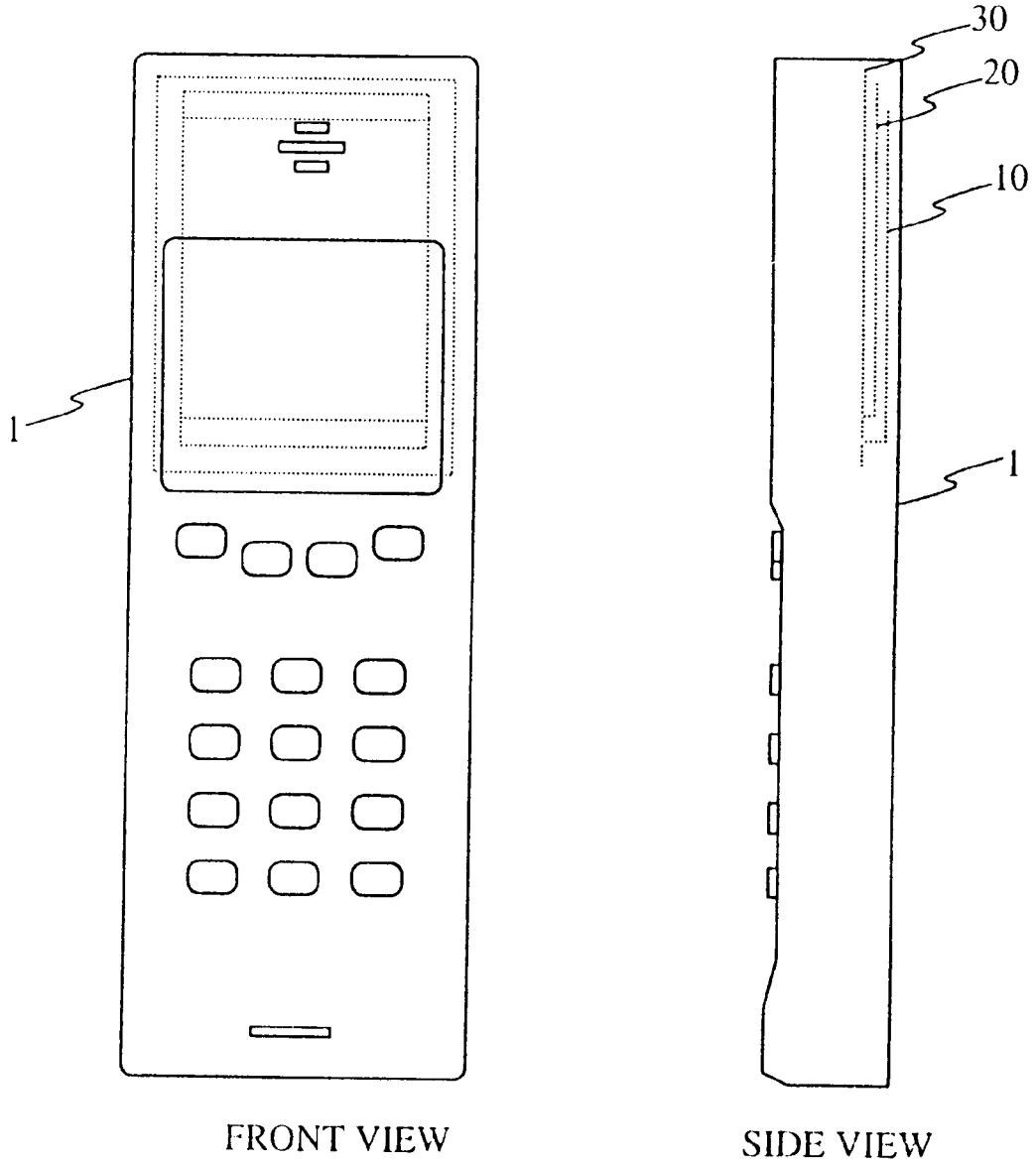

FIG. 5*a* shows the structure of a preferred embodiment of the invention in which the second strip is divided into two sections;

FIG. 5*b* shows another structure of a preferred embodiment of the invention in which the second strip is divided into two sections;

FIG. 5*c* shows a possible way in which the radiating strip of the antenna structure according to the invention is divided into sections;

FIG. 5*d* shows another possible way in which the radiating strip of the antenna structure according to the invention is divided into sections;

FIG. 6 shows a preferred way to realise the short circuiting member 110;

FIG. 7 shows another preferred way to realise the short circuiting member 110;

FIG. 8 shows a third preferred way to realise the short circuiting member 110; and FIG. 9 shows as an example an object in which the antenna according to the invention is applied.

The same reference numerals and markings are used to identify like parts.

Figure 1A:
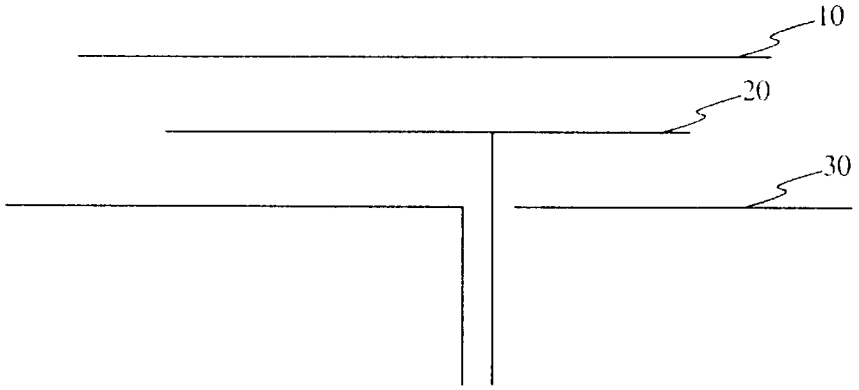
Fig. 1a PRIOR ART
Figure 1B:
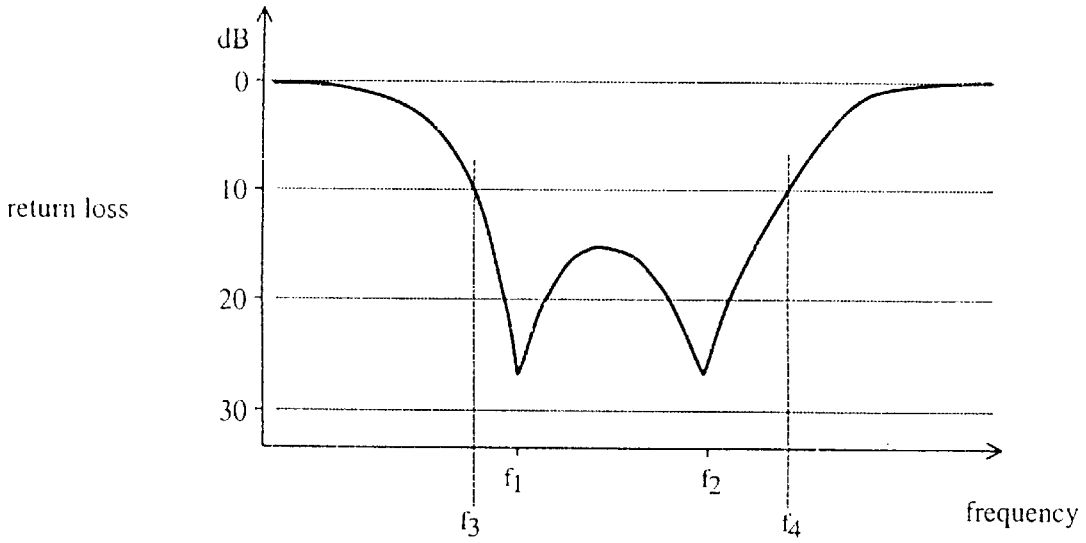
Fig. 1b PRIOR ART
Figure 1C:
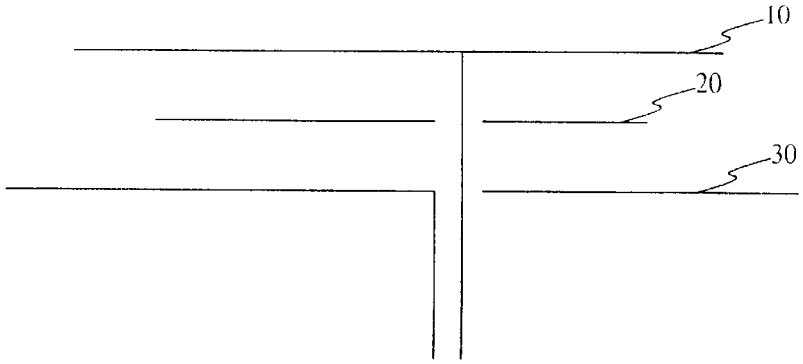
Fig. 1c PRIOR ART
Figure 1D:
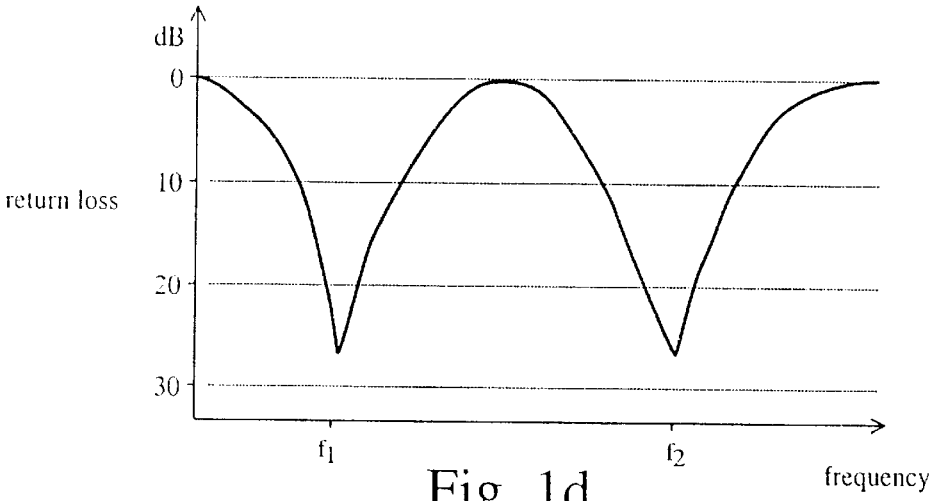
Fig. 1d PRIOR ART
Figure 2:
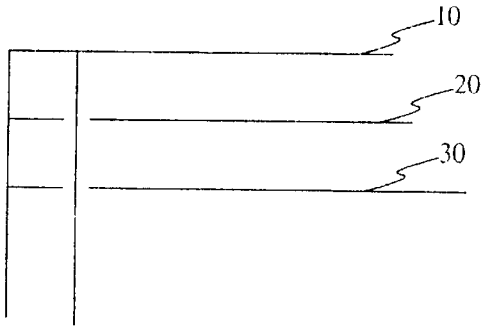
Fig. 2 PRIOR ART
FIG. 2 shows a prior art antenna formed by short circuited microstrips and having two bands.
Figure 3:
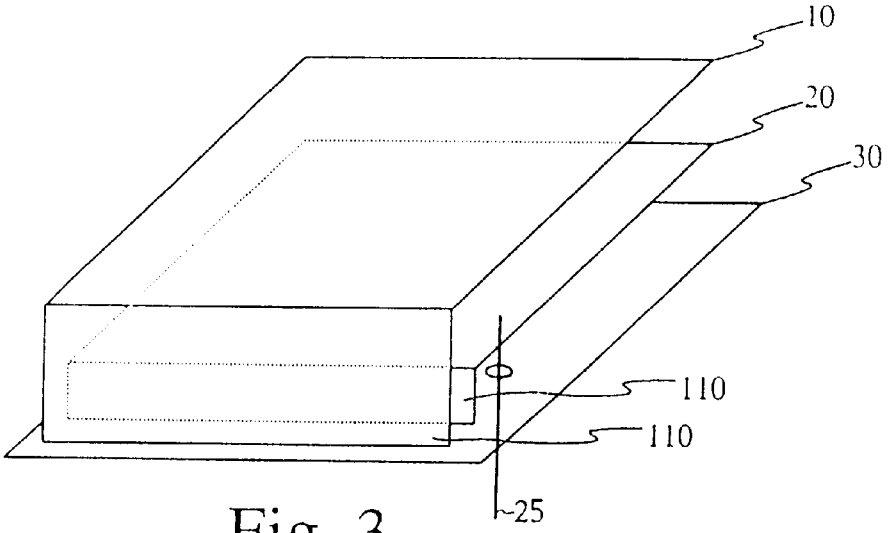
FIG. 3 shows the basic structure of a preferred embodiment of the invention.

The FIGS. 1*a*, 1*b*, 1*c*, 1*d* and 2 were described above when the prior art was described. FIG. 3 presents the basic structure of a preferred embodiment of the invention. The antenna comprises a ground plane 30, a lower strip 20 and an upper strip 10. The strips 10, 20 are short circuited to the ground plane 30 by short circuiting member 110. The antenna feed is connected to the lower strip 20. The frequency response of an antenna structure of this kind depends on the dimensions of the elements in the antenna structure. Both strips 10, 20 have a certain resonance frequency, which in the structure according to the invention are tuned slightly apart, whereby the antenna structure will have a wider useful frequency range.

In the antenna structure according to the invention the power is fed by a feed 25 into the lower strip 20, and the upper strip operates as an electromagnetically coupled radiator. As a method to feed the antenna it is possible to use a pin feed realised e.g. by a coaxial cable or by other means, a feed realised by a microstrips, a hole-feed, a slotted line feed, a feed realised by a coplanar line, a proximity-coupled feed, or some other prior art feeding method commonly used in microstrips antennas. The antenna structure according to the invention can also have more than two strips 10. 20. In this kind of applications the antenna feed can be connected to any one of the radiating strips which are located between the ground plane and the upper radiator.

In the antenna structure according to the invention the strips 10, 20 can have the same width, or they can have different widths. In the antenna structure according to the invention the strips 10, 20 preferably have a length which is about one quarter-wave. The preferred length L of the strips 10, 20 can be approximated with the formula below:

$$L = \frac{\lambda_0}{4} - h$$

where h is the distance between the lower face of the strip and the upper face of the around plane. It should be noted that this formula is applicable only for microstrips antennas with air dielectric, and the formula only approximates suitable lengths for the strips.

In addition to a rectangular design the strips 10, 20 of the antenna according to the invention can also have many different forms, for instance circular, triangular or pentagonal, according to the requirements of the application. It is also possible to bend the strips in many different ways, whereby for instance the distance between the lower strip and the ground plane can be larger in the open end than in the short circuited end.

In the antenna structure according to the invention the width of the strips 10, 20 can vary according to the requirements of the respective embodiment. The strips can have different widths. At the minimum end the strips can be thread like, very close to a theoretically ideal one-dimensional, infinitely narrow element.

With the design of the strips it is possible to influence the coupling between the strips and thus the characteristics of the whole antenna structure. In an antenna structure according to the invention which has two strips 10, 20, the upper strip is preferably as wide as or narrower as the lower strip. When the upper strip is made wider it is possible to increase the coupling of the upper strip to the field between the lower strip and the ground plane. However, in an antenna structure according to the invention this coupling is relatively strong, due to the small distance between the strips, whereby there is no need to increase the coupling by making the upper strip wider than the lower strip.

With the size of the ground plane it is possible to have an influence on the radiation pattern of the antenna according to the invention. If the ground plane is larger than the radiator the antenna's radiation pattern is stronger in the direction opposite to the ground plane, but if the ground plane is substantially as large as the radiator, then the antenna has an equal radiation in both directions. The size of the ground plane also has an influence on the bandwidth: an increased size of the ground plane reduces the bandwidth.

The resonance frequency of any of the strips or strip sections in the antenna structure of the invention can be controlled by their dimensioning and also with parasitic strips which are adjacent to the strip or strip section and lie in the same plane.

Figure 4:
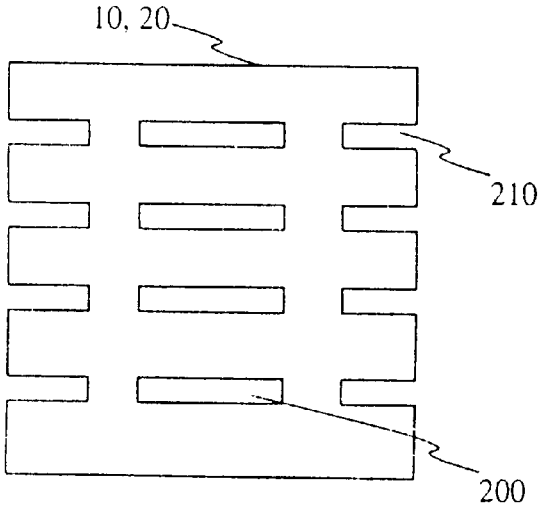
FIG. 4 shows the design of the strips in a preferred embodiment of the invention.

In a preferred embodiment of the invention the strips 10, 20 have gaps, which reduce the physical size of the strips. FIG. 4 shows one possible structure of the strip 10, 20 of this embodiment. In this embodiment the strip can have one or more gaps 200 and indents 210, as shown in FIG. 4. The effect of a gap 200 or indent 210 is based on the fact that due to the gap or indent the current flowing in the strip must travel a longer way than in a corresponding strip without indents, whereby the electrical length of the strip increases. Thus the gaps 200 and indents 210 act as means which increase the inductance.

FIG. 5*a* shows a preferred embodiment of the invention where the upper strip is 10 divided into two sections. In this embodiment the strip sections 11 can be tuned to slightly different resonance frequencies, which results in an increased number of resonance peaks in the resonance band of the total antenna structure, which thus increases the bandwidth of the total antenna structure. For instance, if the upper strip is divided into two sections and the sections are tuned to different frequencies by changing their length, then the antenna will be a broadband antenna with three resonators. The upper strip could also be divided into more than two sections.

In an embodiment like this the distance between the strip sections 11 must be larger than a certain limit: if the distance between the strips is very small, then their electromagnetic coupling is so strong that the strip sections act as one undivided strip.

In another preferred embodiment of the invention the bandwidth of the antenna structure is made wider by dividing also the lower strip into more than one section. In an embodiment of this kind it is possible to feed the power into one ore more strip sections.

FIG. 5*b* shows a preferred embodiment of the invention similar to that of FIG. 5*a*, but where the upper strip sections 11 and the lower strip 20 have a common short circuiting plate 110.

FIG. 5*c* shows a possible way to divide a strip 10, 20 in an antenna structure according to the invention. The width of the strip sections 11 can vary also within the same strip. It is also possible to make projections 12 in the strips with which it is possible to influence the coupling between the strip sections.

FIG. 5*d* shows another possible way to divide a strip 10, 20 in an antenna structure according to the invention. The strip sections can also be connected by one or more narrow joining strips 13. In this embodiment it is possible to have an influence on the coupling between the strip sections by selecting the position and the width of the joining strip 13, by selecting the number of joining strips 13, and by varying the distance between the strip sections 11 connected by a joining strip 13.

In FIGS. 5*c* and 5*d* the strip sections can be strip sections which result from a division of any of the strips 10, 20.

In the antenna structure according to the invention the grounding of the radiators can be realised in many different ways. FIG. 3 shows a preferred embodiment of the invention, in which the radiators 10, 20 are connected to the ground plane 30 by an electrically conducting plate 110 connected to one edge of the radiator 10, 20. In the embodiment of FIG. 3 both strips 10, 20 are grounded by an own electrically conducting plate 110. In the antenna structure according to the invention these plates can be interconnected through the around plane 30 and in addition also by a separate electrically conducting member, or the plates can partly contact each other. In the antenna structure according to the invention the rounding can also be common, whereby there is only one electrically conducting plate 110, to which all strips are fastened.

Another preferred way to ground the strips, i.e. using through coppered holes, can be used particularly in an embodiment in which there is a dielectric insulating layer between the strips. FIG. 6 shows a preferred embodiment of the invention, in which the strips 10, 20 are connected to the ground plane 30 by using through coppered holes 100. FIG. 6 shows this structure in a top view and as a section along the line A–B. In the embodiment of FIG. 6 the strips 10, 20 are connected separately to the ground plane. In this embodiment the through coppered holes 100 of the upper strip 10 do not have a galvanic connection to the lower strip 20.

FIG. 7 shows another preferred embodiment of the invention, in which the connection of the strips 10, 20 to the ground plane 30 is realised by through coppered holes 100. FIG. 7 shows this structure in a top view and as a section along the line A–B. In the embodiment of FIG. 7 the strips 10, 20 are jointly connected to the ground plane, whereby the through coppered holes 100 form the contact both to the upper strip 10 and to the lower strip 20.

To a person skilled in the art it is obvious that the number of the holes 100 can vary according to the requirements of the respective embodiment, and that in addition to the coppered holes the electrically conducting connection of the holes 100 can be realised also in some other known manner, such as with a short circuiting pin or a lead-through sleeve.

It is preferable to use through coppered holes 100 or corresponding lead-throughs as short circuiting members, because with them it is possible to influence the inductance of the short circuit in the same way as the gaps 200 can have an influence on the inductance of the strips. The strips 10, 20 can be made shorter, retaining the same resonance frequency, by reducing the number of the through coppered holes, as this increases the inductance of the short circuit. However, an increased inductance may reduce the bandwidth of the antenna.

The inductance of the short circuiting members 110 can also be increased in other ways. For instance, the strips 10, 20 of the antenna structure shown in FIG. 1 can be made shorter by adding gaps 200 or other means for increasing the inductance to the short circuiting members 110, for instance in the manner shown in FIG. 8.

The figures of this application present such illustrative embodiments of the invention in which the short circuiting plate 110 is perpendicular to the strip 10, 20. However, the invention is not limited to these examples, but the angle between the short circuiting plate 110 and the strip 10, 20 can also be any other angle than a right angle. The short circuiting member can also be formed by bending one end of the strip 10, 20 into an arcuate form and by fastening this bent end to the ground plane 30, whereby there is no angle between the short circuiting member formed in this manner and the radiating part of the strip.

In the antenna structure according to the invention the dielectric between the radiators 10, 20 and the dielectric between the lower radiator 20 and the ground plane can advantageously be some low loss microstrips substrate material known by a person skilled in the art, e.g. a suitable printed board material. Also air can act as the dielectric material. For example, the antenna may be realised with at least two stacked printed boards, each having at least one electrically conducting layer with patterns forming the antenna elements on the surfaces of the boards, or with a single multilayer board having conductive elements formed in the various layers of the multilayer board for realising at least the ground plane and the strips of the antenna. In these examples, the short circuiting members can advantageously be realised with electrically conducting lead-throughs formed in the board or boards.

The antenna structure according to the invention provides a wide frequency response, with one antenna structure according to the invention we measured for the 10 dB return loss a bandwidth, which was even 14% of the centre frequency, which is more than twice the value compared to the bandwidth of a prior art microstrips antenna with a corresponding thickness.

With the antenna structure according to the invention it is possible to realise thinner microstrips antennas than in prior art, and still obtain a wide useful antenna bandwidth, which is required for instance in mobile stations of the DCS-1800 system.

FIG. 9 shows as an example an object in which the antenna according to the invention is advantageously applied, i.e. a mobile station. According to FIG. 9 the antenna structure according to the invention can be located inside the cover of the mobile station 1, whereby it is protected from shocks and blows directed against the mobile station. This is a significant advantage compared to conventional whip antennas, because the whip antennas used in conventional mobile stations are easily bent or broken, if the user inadvertently drops the mobile station.

The broadband antenna according to the invention can also be utilised in almost any other prior art radio application requiring a small-sized antenna, such as in a base station of a wireless office system. A thin planar antenna can be located for instance in the same box as the other components of the base station, whereby it is simple to install a base station of this kind on the wall in an office corridor, for instance, without a separately installed antenna. An embodiment of this kind can advantageously use the directivity of the antenna structure according to the invention: when the ground plane 30 is made slightly larger than the other strips 10, 20, the radiation pattern of the antenna can be emphasised to lie more on the same side of the ground plane as the strips 10, 20. This provides the advantage that the radiation power of the antenna is then stronger in the desired space, and radiation power is not lost in the mounting surface of the base station, for instance.

In this application the term "microstrip antenna" also relates to air-dielectric self-supporting structures, in addition to microstrips antennas realised on different substrates.

To a person skilled in the art it is obvious that the above described embodiments can be combined in many different ways in different applications of the antenna structure according to the invention. Above the invention was described with reference to some of its advantageous embodiments, but it is obvious that the invention can be modified in many different ways within the inventive idea defined in the enclosed claims.

We claim:

1. A microstrip antenna having a ground plane, a first strip and a second strip arranged between the ground plane and the first strip, comprising a first short circuiting member and a second short circuiting member, whereby one end of the first strip is short circuited to the ground plane by said first short circuiting member and the corresponding end of the second strip is short circuited to the ground plane by said second short circuiting member, the first strip having a first resonance frequency and the second strip having a second resonance frequency, whereby the first and the second resonance frequencies form a substantially continuous operating band, means for increasing the inductance of a strip in at least one of the strips, means for increasing the inductance of a short circuiting member in at least one of said short circuiting members, and an antenna feed connected to the second strip.

2. A microstrip antenna according to claim 1, wherein at least one of the strips is divided into at least two sections.

3. A microstrip antenna according to claim 2, wherein said at least two sections are interconnected by an electrically conducting connection.

4. A microstrip antenna according to claim 2, wherein said first and second short circuiting members are at least partly interconnected.

5. A microstrip antenna according to claim 1, comprising a multilayer microstrip substrate, electrically conductive patterns formed in the conductive layers of said substrate for forming the ground plane and the strips of the antenna, and electrically conducting lead-throughs between the conductive layers of said substrate for forming said short circuiting members.

6. A microstrip antenna according to claim 1, comprising at least two microstrip substrates with at least one electrically conducting layer, electrically conductive patterns formed in the conductive layers of said substrates for forming the ground plane and the strips of the antenna, and electrically conducting lead-throughs between the conductive layers of said substrates for forming said short circuiting members.

7. A mobile station, comprising a microstrip antenna, a ground plane in said microstrip antenna, a first strip in said microstrip antenna, the first strip having a first resonance frequency, a second strip in said microstrip antenna arranged between the ground plane and the first strip, the second strip having a second resonance frequency, whereby the first and the second resonance frequencies form a substantially continuous operating band, a first short circuiting member and a second short circuiting member, whereby one end of the first strip is short circuited to the ground plane by said first short circuiting member and the corresponding end of the second strip is short circuited to the ground plane by said second short circuiting member, means for increasing the inductance of a strip in at least one of the strips, means for increasing the inductance of a short circuiting member in at least one of said short circuiting members, and an antenna feed connected to the second strip.

* * * * *